US006602119B1

(12) United States Patent
Togawa et al.

(10) Patent No.: US 6,602,119 B1
(45) Date of Patent: Aug. 5, 2003

(54) DRESSING APPARATUS

(75) Inventors: Tetsuji Togawa, Kanagawa-ken (JP); Kuniaki Yamaguchi, Kanagawa-ken (JP); Nobuyuki Takada, Kanagawa-ken (JP); Satoshi Wakabayashi, Kanagawa-ken (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/588,537

(22) Filed: Jun. 7, 2000

(30) Foreign Application Priority Data

Jun. 8, 1999 (JP) ..... 11-161595

(51) Int. Cl.[7] ..... B24B 7/00

(52) U.S. Cl. ..... 451/72; 451/451; 451/56; 451/443

(58) Field of Search ..... 125/2, 3, 8; 451/56, 451/72, 285, 286, 287, 288, 289, 290, 443, 444

(56) References Cited

U.S. PATENT DOCUMENTS 5,209,020 A * 5/1993 Feisel ..... 451/72
5,531,635 A 7/1996 Mogi et al.
5,833,520 A * 11/1998 Kanda et al. ..... 451/72
5,842,912 A * 12/1998 Holzapfel et al. ..... 451/72
6,022,266 A * 2/2000 Bullard et al. ..... 451/56
6,062,969 A * 5/2000 Klicpera ..... 451/56
6,099,393 A * 8/2000 Katagiri et al. ..... 451/56
6,200,199 B1 * 3/2001 Gurusamy ..... 451/56
6,200,207 B1 * 3/2001 Hsu ..... 451/443
6,203,413 B1 * 3/2001 Skrovan ..... 451/72
6,206,760 B1 * 3/2001 Chang et al. ..... 451/41
6,213,856 B1 * 4/2001 Cho et al. ..... 451/443
6,217,430 B1 * 4/2001 Koga et al. ..... 451/444
6,227,947 B1 * 5/2001 Hu et al. ..... 451/56

FOREIGN PATENT DOCUMENTS

JP 4-87768 3/1992

* cited by examiner

*Primary Examiner*—Timothy V. Eley
(74) *Attorney, Agent, or Firm*—Wenderoth, Lind & Ponack, L.L.P.

(57) ABSTRACT

Disclosed is a dressing apparatus wherein a polishing surface can be regenerated stably over a long period without any danger of an object to be polished being scratched. A dressing surface 50*a* of a dresser 48 is caused to slide on a polishing surface 30*a* of a polishing table 22 while the dressing surface is urged against the polishing surface. The dressing surface is formed from a grindstone 50.

24 Claims, 4 Drawing Sheets

DRESSING APPARATUS

BACKGROUND OF THE INVENTION

1. Field of the Invention

The present invention relates to a dressing apparatus for use with a polishing apparatus for polishing a work object to be polished, such as a semiconductor wafer, which is used to regenerate a polishing surface of a polishing table.

2. Related Arts

With recent rapid progress in technology for fabricating high-integration semiconductor devices, circuit wiring patterns have been becoming increasingly fine and, as a result, spaces between wiring patterns have also been decreasing. As wiring spacing decreases to less than 0.5 microns, the depth of focus in circuit pattern formation in photolithography or the like becomes shallower. Accordingly, surfaces of semiconductor wafers on which circuit pattern images are to be formed by a stepper are required to be polished by a polishing apparatus to an exceptionally high degree of surface flatness, and a polishing process using a polishing apparatus is conducted as one method for obtaining such surface flatness.

A polishing apparatus of this kind generally comprises a polishing table on which a polishing cloth is provided to form a polishing surface, and a top ring for holding a substrate (object to be polished) with a surface thereof (to be polished) being orientated towards the polishing table. The substrate is urged against the polishing table under a predetermined pressure exerted by the top ring while rotating the top ring and the polishing table so that the surface of the substrate is polished to have a flat and mirror-finish surface while a polishing liquid is supplied.

A dressing apparatus is disposed aside the polishing table, and, by rotating the dressing apparatus and the polishing table while urging a flat dressing surface of the dressing apparatus against the polishing surface of the polishing table, any polishing liquid and abraded particles adhering to the polishing surface are removed and the polishing surface is normalized.

SUMMARY OF THE INVENTION

Problems to be Solved by the Invention

The dressing surface of the dressing apparatus comprises particles such as diamond particles which are adhered to the lower surface of a dresser by means of electrical deposition. However, during the dressing, some particles detach from the dressing surface and remain on the polishing surface of the polishing table, with the result that scratches are formed on the substrate. Further, in such a dresser, since diamond particles are usually adhered by electrical deposition in the form of a single layer, detachment and deterioration of the particles tends to occur, which necessitates the frequent exchange or replacement of the dresser itself. This is a time-consuming and costly operation.

The present invention aims to eliminate the above-mentioned drawbacks, and an object of the present invention is to provide a dressing apparatus in which a polishing surface can be regenerated for a long period without any danger of scratching an object to be polished.

Means for Solving the Problems

According to a first aspect of the present invention, there is provided a dressing apparatus in which a dressing surface of a dresser is urged in a sliding motion against a polishing surface, the dressing surface being formed from grindstone.

The grindstone is formed by binding abrasive particles having a particle diameter of 1 micrometer or less by means of a predetermined binder to obtain a layer having a predetermined thickness. Since the abrasive particles have a small diameter, even if the abrasive particles remain on the polishing surface of the polishing table, an object to be polished (substrate) can be prevented from being damaged by the abrasive particles. It is preferable that strength of the binder be selected so that the abrasive particles can be held in opposition subject to whatever force is applied during a dressing operation, and that such a binder strength be adjusted in accordance with the selection of a material and setting of a void ratio.

By setting the strength and property of the binder so that the binder is gradually denuded to form a new dressing surface as the dressing operations progress, a dresser having a long service life can be provided. As the dressing grindstone, a grindstone may have a so-called "abrasive particle self-generating function" formed by binding polishing particles by means of a binder having certain dissolving or destroying ability so that the abrasive particles are regenerated due to dissolution or destruction of the binder may be used.

According to a second aspect of the present invention, in the dressing apparatus according to the first aspect, a grindstone configuration correcting mechanism for maintaining a flat dressing surface is further provided, whereby the dressing surface of the grindstone is reoriented as necessary, to maintain a constant surface configuration.

According to a third aspect of the present invention, in the dressing apparatus according to the first or second aspect, the dressing surface is provided with a number of grooves or minute holes. By this arrangement, an abrasive particle removing function during dressing can be enhanced, a lubricating and cooling function of the dressing liquid for the dressing surface can also be enhanced, and, a surface tension force during the separation of the grindstone from the polishing table or the grindstone configuration correcting machine can be reduced to facilitate separation.

According to a fourth aspect of the present invention, there is provided a polishing apparatus comprising a polishing table having a polishing surface, a substrate holding member for holding a substrate and for urging the substrate against the polishing surface, and a dressing apparatus according to any one of the first to third aspects.

According to a fifth aspect of the present invention, in the polishing apparatus according to the fourth aspect, a fluid injecting mechanism for injecting fluid onto the polishing surface of the polishing table or the dressing surface of the dresser is further provided. By this arrangement, fluid is supplied between the grindstone and the polishing surface of the polishing table by the fluid injecting mechanism, thereby reducing the surface tension force between the grindstone and the polishing surface so as to facilitate separation of the grindstone from the polishing surface.

According to a sixth aspect of the present invention, in the polishing apparatus according to the fourth aspect, a residual abrasive particle cleaning nozzle for removing from the polishing table abrasive particles which have become detached from the grindstone is disposed in the vicinity of the polishing table. By this arrangement, any residual abrasive particles can be quickly removed.

BRIEF DESCRIPTION OF THE DRAWINGS

FIG. 3(*a*) shows the dresser 48 above the correcting table 54, FIG. 3(*b*) shows the dresser 48 urged against the correcting table 54;

REFERENCE SIGNS IN THE DRAWINGS

Figure 1:
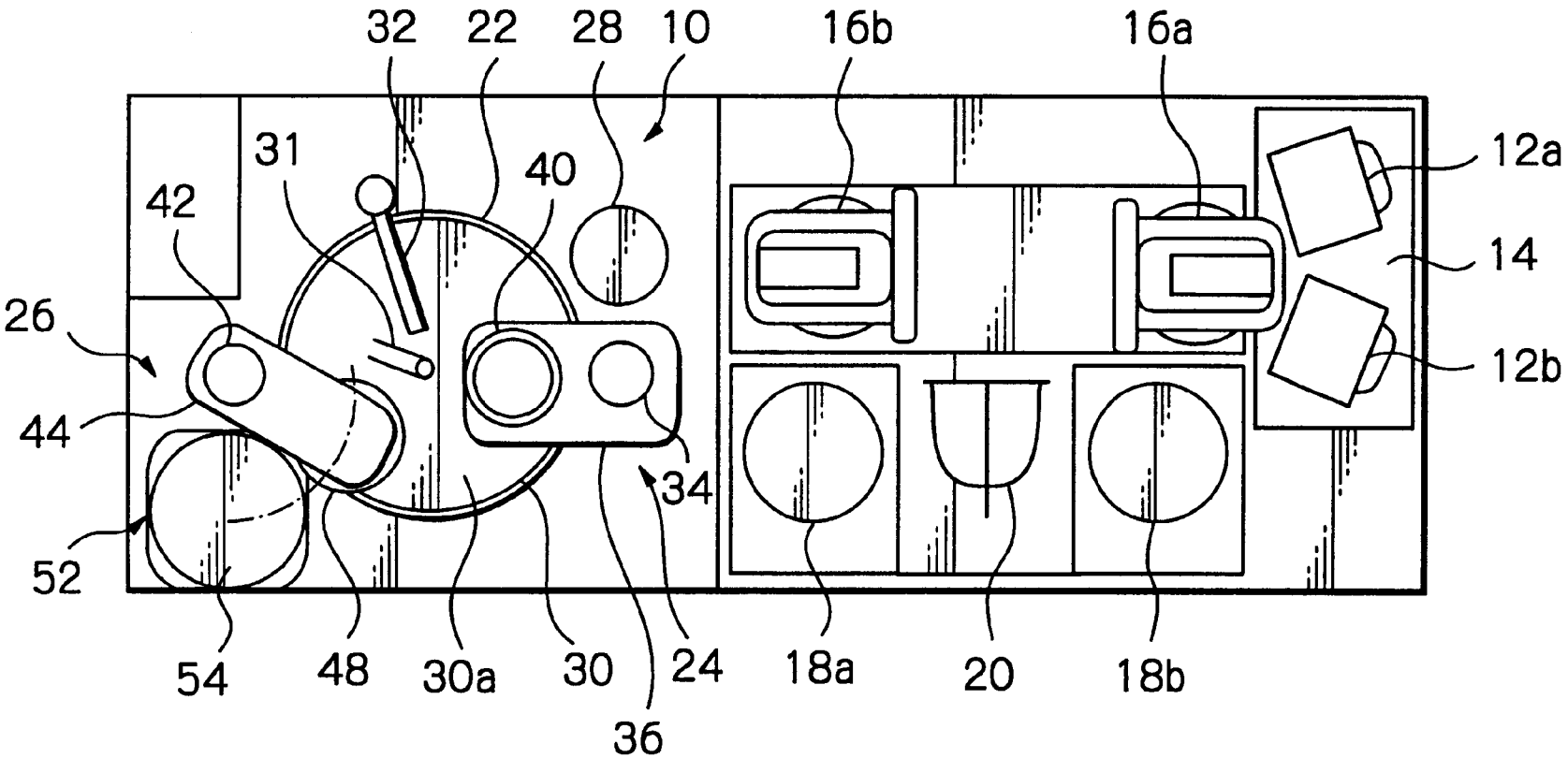
FIG. 1 is a plan view of a polishing apparatus having a dressing apparatus 26 according to an embodiment of the present invention.

10: polishing apparatus, 22: polishing table, 24: top ring, 26: dressing apparatus, 30: polishing cloth, 30*a*: polishing surface, 32: cleaning nozzle member, 36, 44: head, 38, 46: shaft, 40: top ring, 48: dresser, 50: grindstone, 50*a*: dressing surface, 52: grindstone configuration correcting mechanism, 54: configuration correcting table, 56*a*, 56*b*: water supply nozzle member.

DETAILED DESCRIPTION OF THE INVENTION

The present invention will now be explained in connection with embodiments thereof with reference to the accompanying drawings.

FIGS. 1 to 4 show a polishing apparatus including a dressing apparatus according to an embodiment of the present invention. The polishing apparatus is installed in a rectangular space on a floor, and a polishing apparatus 10 is disposed at one end of the space and a load/unload unit 14 on which a substrate containing cassettes 12*a*, 12*b* are rested is disposed at the other end of the space. Between the polishing apparatus 10 and the load/unload unit 14, there are provided two conveying robots 16*a*, 16*b* and two cleaning devices 18*a*, 18*b* in opposing relation to each other, and a reversing mechanism 20 is located between the cleaning devices 18*a* and 18*b*.

The polishing apparatus 10 includes a polishing table 22, and a top ring device 24 and a dressing apparatus 26 with the interposition of the polishing table 22. A pusher 28 for sending and receiving a substrate with respect to the conveying robot 16*b* is disposed aside the polishing table 22.

Figure 2:
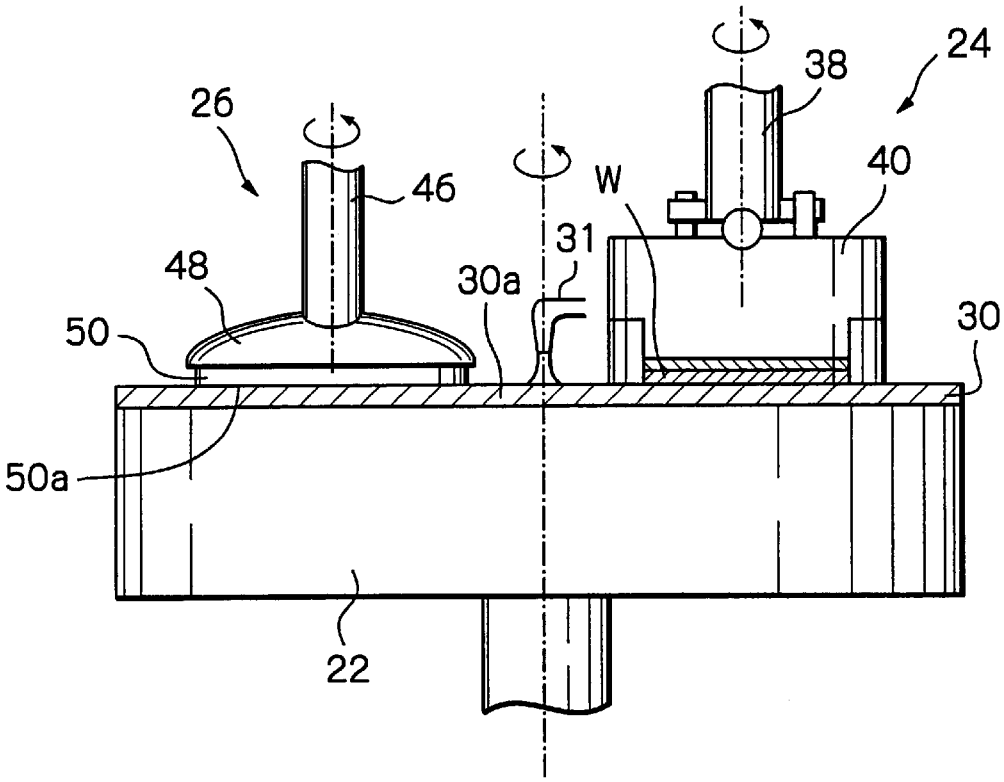
FIG. 2 is a sectional view showing a condition where a polishing operation is being performed in the apparatus of FIG. 1.

As shown in FIG. 2, a polishing cloth (polishing member) 30 is adhered to an upper surface of the polishing table 22, and a flat polishing surface 30*a* is formed on the polishing cloth 30. The polishing table 22 is rotated by a drive motor (not shown) disposed below the polishing table. Above the polishing surface 30*a*, there are provided a polishing liquid supplying nozzle 31 the opening of which is located above a center of the polishing table 22, and a residual abraded particle cleaning nozzle member having a plurality of holes located above and opening along a radius of the polishing table 22. The cleaning nozzle member 32 serves to remove detached abrasive particles remaining on the polishing surface 30*a*, for example, by injecting a gas such as nitrogen gas or a liquid such as pure water or a chemical agent liquid onto the polishing surface 30*a*. It should be noted that in place of the polishing cloth 30, a grindstone (including fixed abrasive particles) may be used.

The top ring device 24 includes a support post 34, and a top ring head 36 attached to a distal end of the support post 34 and rocked by a servo motor or the like. A top ring shaft 38 is attached to a free end of the top ring head 36 for rotational and vertical movements induced by a motor (not shown) and a cylinder for generating vertical movement (not shown), and a substantially disc-shaped top ring (substrate holding member) 40 is attached to a lower end of the top ring shaft 38.

With the arrangement described above, by way of a horizontal swing movement of the top ring head 36, the top ring 40 can be shifted between an upper position (polishing position) on the polishing surface 30*a*, a substrate sending/receiving position on the pusher 28 and a standby position, and the top ring shaft 38 and the top ring 40 are together rotated and shifted in a vertical direction by driving the motor disposed within the top ring head 36 and by activating the cylinder for generating vertical movement.

Similarly, the dressing apparatus 26 includes a support post 42, and a dresser head 44 attached to a distal end of the support post 42 and rocked by a servo motor or the like. A dresser shaft 46 is attached to a free end of the dresser head 44 for rotational and vertical movement generated by a motor (not shown) and a vertical movement applying cylinder (not shown), and a dresser 48 is attached to a lower end of the dresser shaft 46.

The dresser 48 is a disc-shaped member in a taper form flaring in an outward direction downwardly. A thin circular plate-shaped grindstone (including fixed abrasive particles) 50 is fixed to a lower surface of the dresser, and a dressing surface 50*a* is defined on a lower surface of the grindstone 50. The grindstone 50 is manufactured by binding dressing abrasive particles having a predetermined hardness and particle size by a binder having a predetermined strength and void ratio, and by dispersing the particles within the binder. A fine powder of cerium dioxide ($CeO_2$) and the like is used as the dressing abrasive particles, and a heat curing resin such as polyimide is used as the binder.

The abrasive particles should be sufficiently hard to be able to dress the polishing cloth (polishing member) and be of the smallest possible size. Preferably, the particle size of the dressing abrasive particles should be substantially the same as that of the polishing particles included in the polishing liquid. In the illustrated embodiment, the abrasive particles each mainly have a diameter of 1 micrometer or less. The abrasive particles may be formed from $SiO_2$, $Al_2O_3$, $ZrO_2$, $MnO_2$ or $Mn_2O_3$, as well as $CeO_2$.

Further, the binder should be sufficiently strong so as to be able to hold the abrasive particles subject to a force applied to the dressing abrasive particles during a dressing operation which consists of a sliding motion on the polishing member. In order to maintain such a strength, an appropriate binder must be selected or a void ratio decreased. Further, the binder may be designed to gradually lose its function whereby abrasive particles become detached therefrom and a new dressing surface is revealed. In other words, while the dressing surface 50*a* of the grindstone 50 is urged against and slides along the polishing member, a portion of the binder is destroyed, whereby abrasive particles bound by this portion of the binder are released from the grindstone and additional abrasive particles bound by another portion of the binder are presented as the dressing surface. By this arrangement, since the grindstone is formed to have a predetermined thickness, a desired dressing performance can be maintained for a long term, thereby reducing the frequency with which the dresser is required to be replaced.

In consideration of the above, various materials can be selected for use as the binder. For example, phenol resin, urethane resin, epoxy resin or polyvinyl alcohol resin can be used, as well as the aforementioned polyimide resin. The dressing abrasive particles and the binder are appropriately selected in consideration of the kind of polishing member to be dressed and any affinity between the abrasive particles and the binder.

A number of grooves or fine holes may be formed in the dressing surface 50*a* of the dressing grindstone 50 to thereby enhance fluidity of the dressing liquid. Further, a fluid supplying mechanism for supplying fluid such as pure water or $N_2$ gas from the grindstone 50 onto the dressing surface 50*a* may be provided. In this case, a passage for such a fluid is formed within the dresser shaft and is connected to an external supply means via a universal joint.

Figure 3A:
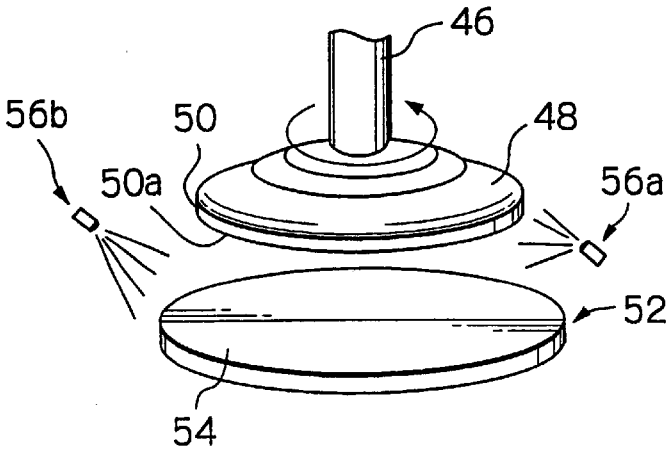
FIGS. 3(*a*) and 3(*b*) are perspective views showing a condition where a configuration of a dressing surface 50*a* is corrected by using the apparatus of FIG. 1.
Figure 3B:
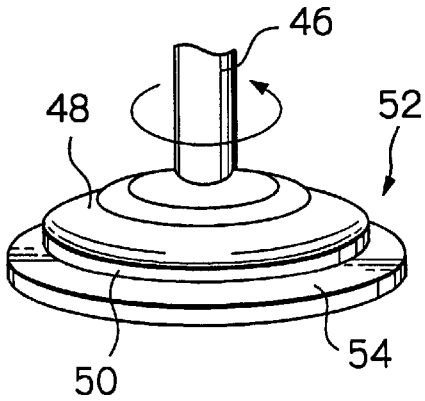

The dressing apparatus 26 is provided with a grindstone configuration correcting mechanism 52 disposed alongside the polishing table 22. As shown in FIGS. 3(*a*) and 3(*b*), the grindstone configuration correcting mechanism 52 comprises a configuration correcting table 54 formed from a porcelain-type material such as a ceramic, a metal material having electrically deposited diamond particles thereon, or a grindstone having a hardness greater than that of the dressing grindstone 50. An upper surface of the configuration correcting table 54 is finished to form a flat surface having a flatness of about 0.20 to 0.01, for example. Further, around the table, there are provided a pure water supply nozzle member 56*a* for supplying pure water to prevent drying of the grindstone, and a pure water supply nozzle member 56*b* for supplying pure water to clean the configuration correcting mechanism. By intermittently supplying pure water from the pure water supply nozzle member 56*a* disposed at the standby position of the dresser 48 to the dressing grindstone 50 during a non-dressing operation, drying of the grindstone 50 is avoided so as to prevent deformation thereof.

In this way, the dresser 48 is shifted between the dressing position above the polishing surface 30*a* and a configuration correcting position above the configuration correcting table 54 by the horizontal rocking movement of the dresser head 44, and the dresser shaft 46 and the dresser 48 are together rotated and shifted in a vertical direction by driving the motor disposed within the dresser head 44 and by activating the vertical movement applying cylinder.

Next, an operation of the polishing apparatus having the above-mentioned arrangement will be explained. First of all, a substrate W is picked up from the cassette 12*a* or 12*b* by the first conveying robot 16*a* and is reversed by the reversing device 20 and is then placed on the pusher 28 by the second conveying robot 16*b*. The top ring 40 is then shifted above the pusher 28 by rocking the top ring head 36 of the top ring device 24 which was formerly in a standby position, and then, the pusher 28 is lifted, so that the substrate W is absorbed and held by the top ring 40. Then, the top ring 40 is shifted above the polishing surface 30*a* by rocking the top ring head 36 of the top ring device 24 in a horizontal direction. And, as shown in FIG. 2, the top ring 40 is lowered while being rotated, thereby urging the top ring against the polishing surface 30*a* of the polishing table 22 which is being rotated by the drive motor. At the same time, a polishing liquid is supplied from the polishing liquid supply nozzle member 31. In this way, the substrate W is polished.

After the polishing operation is complete, the top ring 40 is translated above the polishing surface 30*a* by the top ring head 36 while rotating the top ring 40, and then, the top ring head 36 is stopped at an overhanging position where an area of about 50% of the substrate W protrudes outwardly from the polishing surface 30*a* and the center of the substrate W is located above the polishing surface 30*a*. The top ring 40 is lifted to separate the top ring 40 and the substrate W from the polishing cloth 30 in this state whereby a surface tension acting between the substrate W and the polishing cloth 30 is reduced so as to facilitate accurate lifting and prevent any accidental movement.

In the top ring device 24, the top ring 40 is shifted above the pusher 28 by rocking the top ring head 36, and the polished substrate W is received by the pusher 28, and the substrate W and the top ring 40 are cleaned, if necessary, by supplying pure water or a cleaning liquid. Thereafter, the top ring receives a new substrate W from the pusher 28 and is returned to the polishing table 22, and a fresh polishing operation commences.

Figure 4:
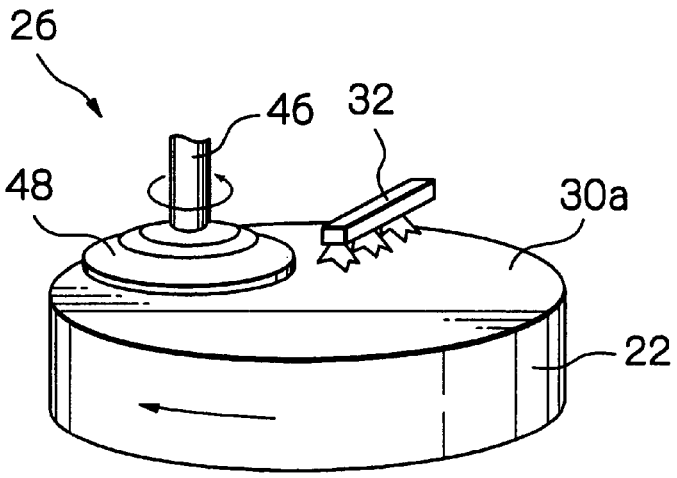
FIG. 4 is a perspective view showing a condition where a dressing operation is being performed in the apparatus of FIG. 1.

While the substrates W are being exchanged by the top ring, dressing for the polishing cloth is performed. Namely, the dresser 48 is located at the dressing position above the polishing surface 30*a*, and the dresser 48 is lowered while being rotated, with the result that the dresser is urged against the polishing surface 30*a* of the polishing table 22, thereby regenerating the polishing surface 30*a*. As shown in FIG. 4, a cleaning fluid is ejected from the residual abraded particle cleaning nozzle member 32 having openings arranged along a radius of the polishing table, thereby removing any detached polishing particles from the polishing surface 30*a*. As a cleaning fluid, pure water is normally used, and the water may be ejected under high pressure (water jet).

Since the dressing grindstone 50 is mainly formed from abrasive particles having a diameter of 1 micrometer or less, even if abrasive particles detached from the binder of the grindstone 50 during dressing remain on the polishing surface 30*a* of the polishing table 22, the particles are buried in the polishing cloth 30, and the substrate W will not be scratched. It should be noted, as shown in FIG. 2, that dressing may be performed while a polishing operation is being conducted by the top ring on the polishing table. In this case, damage resulting from abrasive particles detached from the grindstone 50 can also be prevented.

Further, since the dressing grindstone 50 has a predetermined thickness, a new dressing surface is created as the binder denudes, revealing a new surface, whereby the need for frequent replacement of the grindstone is obviated.

After the dressing operation, the dresser 48 is translated above the polishing surface 30*a* by the dresser head 44 while rotating the dresser 48, and then, the dresser head 44 is brought to a halt at an overhanging position where an area of about 50% of the grindstone 50 protrudes outwardly from the polishing surface 30*a*, and the center of the grindstone 50 is located above the polishing surface 30*a*. In this overhanging condition, the dressing grindstone 50 is lifted to separate it from the polishing surface 30*a*. Thereafter, the dresser head 44 of the dressing apparatus 26 is rocked to shift the grindstone 50 above the configuration correcting table 54.

By providing a number of grooves or minute holes in the dressing surface 50*a* of the grindstone 50, a contact area between the grindstone 50 and the polishing table 22 is reduced, thereby a reduction of surface tension is achieved. Further, a fluid injecting mechanism for injecting fluid from the dressing surface 50*a* of the grindstone 50 may be provided. And, by injecting the fluid from the fluid injecting mechanism, any surface tension acting between the dressing grindstone 50 and the polishing surface 30*a* via liquid can be removed, thereby facilitating separation.

The polished substrate W on the pusher 28 is conveyed, by the second conveying robot 16*b*, to the first cleaning device 18*a* having a dual-surface cleaning function effected by a roll sponge, for example. After both surfaces of the substrate W are cleaned by the cleaning device 18*a*, the substrate is conveyed, by the second conveying-robot 16*b*, to the reversing device 20, where the substrate is reversed. Thereafter, the substrate on the reversing device 20 is picked up by the first conveying robot 16*a*, and the substrate is conveyed to the second cleaning device 18*b* having an upper surface cleaning function (effected by a pin sponge) and a spin dry function, where the substrate is cleaned and dried. Then, the substrate is returned to the cassette 12*a* or 12*b* by the first conveying robot 16*a*.

On the other hand, in the dressing apparatus 26, as shown in FIGS. 3(*a*) and 3(*b*), if necessary or periodically, the dresser 48 is lowered while being rotated (FIG. 3(*a*)), and the dresser is urged against the configuration correcting table 54 (FIG. 3(*b*)), thereby correcting (flattening) the configuration of the dressing surface 50*a*. After the configuration of the dressing surface 50*a* has been corrected, the dresser 48 is moved to an overhanging position relative to the configuration correcting table 54 to facilitate separation form the latter. As described above, since a number of grooves or minute holes are formed in the dressing surface 50*a* of the dressing grindstone 50 and a fluid is injected from the dressing surface 50*a* of the dressing grindstone 50 by the fluid injecting mechanism, separation is made easy.

It should be noted that since the dressing grindstone 50, a grindstone having a so-called "polishing particle self-generating function" is constituted by binding polishing particles by means of a binder that denudes over time thereby revealing a fresh layer of polishing particles operability of the polishing apparatus is greatly enhanced.

Figure 5:
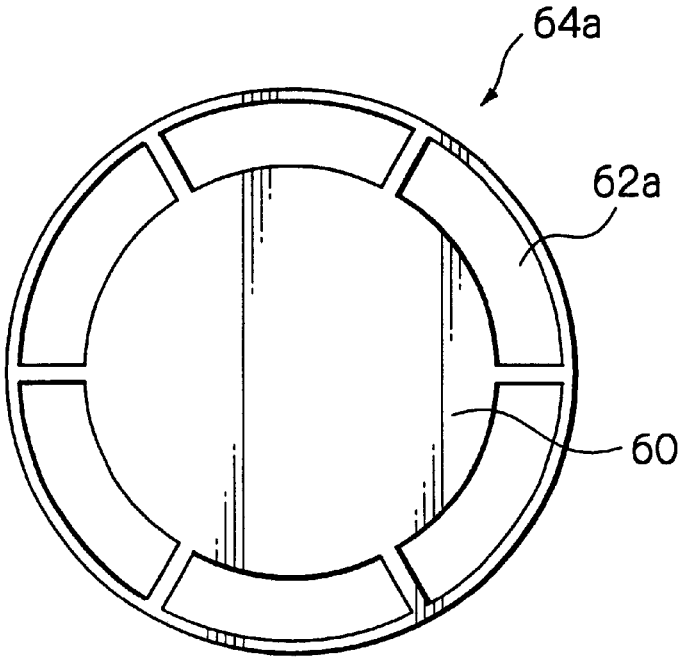
FIG. 5 is a plan view of a dressing grindstone according to another embodiment.
Figure 6:
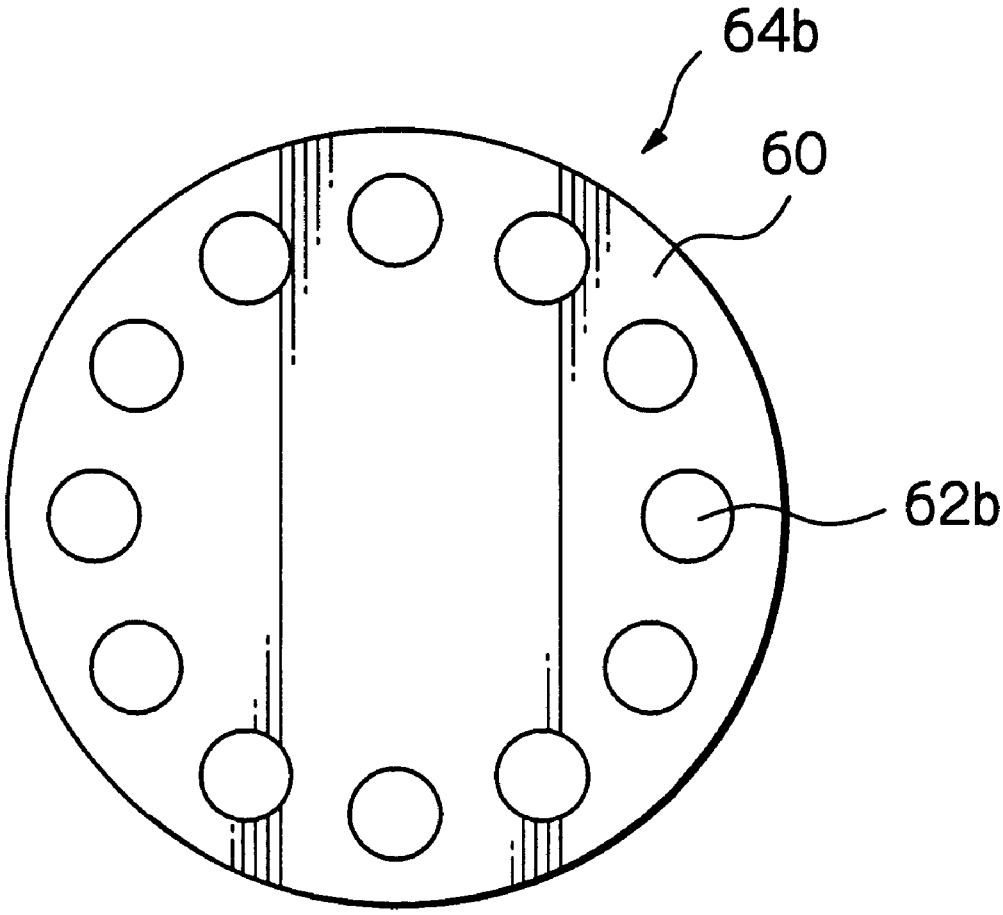
FIG. 6 is a plan view of a dressing grindstone according to a further embodiment.

It should also be noted that, in the above-mentioned embodiments, while an example is given where a flat plate-shaped grindstone is used as explained, as shown in FIGS. 5 and 6, arcuate or pellet-shaped grindstone segments 62*a* or 62*b* may be adhered to an attachment plate 60 in a predetermined pattern such as a ring pattern, or adhered to the entire attachment plate to form a dressing grindstone 64*a* or 64*b*. By such arrangements, since manufacture of a large grindstone is not required, costs can be reduced, and a desired grindstone pattern can easily be achieved.

In the above-mentioned embodiments, while an example is given that a turn table having a circle motion is used as the polishing table, and a polishing cloth is used as the polishing member, a table having a scroll-type movement (revolution movement describing a circular trace or translational circulative motion) or a reciprocal movement may be used, and a grindstone may be used as the polishing member. In this case, the dressing grindstone should be harder than the grindstone used as the polishing table. Further, when the void ratio of the dressing grindstone is less than that of the grindstone used as the polishing member, the service life of the dressing grindstone will be extended. However, in consideration of a 'self-generation' function, it is preferable that the diameters of particles of the grindstones are the same.

As mentioned above, according to the dressing apparatus of the present invention, by employing a grindstone as a dressing surface, the object to be polished is not damaged by residual dressing abrasive particles, and the service life of the dresser can be lengthened, and regeneration of the polishing surface can be effected for a long period.

What is claimed is:

1. A dressing apparatus comprising:

a dressing surface of a dresser which is slidable on a polishing surface of a polishing table while said dressing surface is urged against said polishing surface, said dressing surface being formed from a grindstone, said grindstone comprising abrasive particles and resin for binding said abrasive particles; and a grindstone configuration normalizing mechanism for flattening said dressing surface, said grindstone configuration normalizing mechanism including a configuration correcting table which is to contact said dressing surface.

2. The dressing apparatus according to claim 1, wherein said dressing surface includes a number of grooves.

3. The dressing apparatus according to claim 1, wherein said dressing surface includes a number of minute holes.

4. The polishing apparatus according to claim 1, wherein said resin is destructible such that while said dressing surface is urged against and slides along said polishing surface a portion of said resin is destroyed, whereby abrasive particles bound by this portion of said resin are released from said grindstone and additional abrasive particles bound by another portion of said resin are presented as said dressing surface.

5. The polishing apparatus according to claim 1, wherein said abrasive particles each mainly have a diameter of at most one micrometer.

6. The polishing apparatus according to claim 1, wherein said grindstone configuration normalizing mechanism further includes a pure water supply nozzle member.

7. A polishing apparatus comprising:

a polishing table having a polishing surface;

a substrate holding member for holding a substrate and for urging said substrate against said polishing surface;

a dressing apparatus including a dressing surface of a dresser which is slidable on said polishing surface of said polishing table while said dressing surface is urged against said polishing surface, said dressing surface being formed from a grindstone, said grindstone comprising abrasive particles and resin for binding said abrasive particles; and a configuration normalizing mechanism for flattening said dressing surface, said grindstone configuration normalizing mechanism including a configuration correcting table which is to contact said dressing surface.

8. The polishing apparatus according to claim 7, further comprising a fluid supplying mechanism for supplying fluid to said polishing surface of said polishing table or to said dressing surface of said dresser.

9. The polishing apparatus according to claim 7, further comprising a residual abrasive particle cleaning nozzle, for removing abrasive particles from said polishing table which have become separated from said grindstone, disposed in the vicinity of said polishing table.

10. The polishing apparatus according to claim 7, further comprising a fluid supplying mechanism for supplying fluid to said polishing surface of said polishing table or to said dressing surface of said dresser.

11. The polishing apparatus according to claim 7, further comprising a residual abrasive particle cleaning nozzle, for removing abrasive particles from said polishing table which have become separated from said grindstone, disposed in the vicinity of said polishing table.

12. The polishing apparatus according to claim 7, wherein said dressing surface includes a number of grooves or minute holes.

13. The polishing apparatus according to claim 12, further comprising a fluid supplying mechanism for supplying fluid to said polishing surface of said polishing table or to said dressing surface of said dresser.

14. The polishing apparatus according to claim 12, further comprising a residual abrasive particle cleaning nozzle, for removing abrasive particles from said polishing tale which have become separated from said grindstone, disposed in the vicinity of said polishing table.

15. A polishing apparatus according to claim 12, further comprising a fluid supplying mechanism for supplying fluid to said polishing surface of said polishing table or to said dressing surface of said dresser.

16. The polishing apparatus according to claim 12, further comprising a residual abrasive particle cleaning nozzle, for removing abrasive particles from said polishing table which have become separated from said grindstone table, disposed in the vicinity of said polishing table.

17. The polishing apparatus according to claim 7, wherein said polishing surface is formed on a polishing cloth.

18. The polishing apparatus according to claim 7, wherein said polishing surface is formed from a grindstone including fixed abrasive particles.

19. The polishing apparatus according to claim 7, wherein said grindstone is thin, circular and plate-shaped.

20. The polishing apparatus according to claim 7, wherein said grindstone further comprises voids.

21. The polishing apparatus according to claim 7, wherein said resin is destructible such that while said dressing surface is urged against and slides along said polishing surface a portion of said resin is destroyed, whereby abrasive particles bound by this portion of said resin are released from said grindstone and additional abrasive particles bound by another portion of said resin are presented as said dressing surface.

22. The polishing apparatus according to claim 7, wherein the size of said abrasive particles is substantially the same as that of polishing particles of said polishing surface.

23. The polishing apparatus according to claim 7, wherein said abrasive particles each mainly have a diameter of at most one micrometer.

24. The polishing apparatus according to claim 7, wherein said grindstone configuration normalizing mechanism further includes a pure water supply nozzle member.

* * * * *